United States Patent [19]

Ciuti

[11] Patent Number: 4,487,658

[45] Date of Patent: Dec. 11, 1984

[54] AQUEOUS NEUTRALIZING AND LUBRICATING COMPOSITION FOR DIESEL ENGINES

[75] Inventor: Brunello Ciuti, S.Donato Milanese, Italy

[73] Assignee: Agip Petroli S.p.A, Rome, Italy

[21] Appl. No.: 528,526

[22] Filed: Sep. 1, 1983

Related U.S. Application Data

[63] Continuation of Ser. No. 327,687, Dec. 4, 1981, abandoned.

[30] Foreign Application Priority Data

Dec. 23, 1980 [IT] Italy ..... 26903 A/80

[51] Int. Cl.[3] ..... C10M 3/34

[52] U.S. Cl. ..... 252/33.2; 252/33.4; 252/34.7; 252/49.3

[58] Field of Search ..... 252/33.2, 33.4, 34.7, 252/38, 40.5, 49.3, 52 A

[56] References Cited

U.S. PATENT DOCUMENTS

| | | | |
|---|---|---|---|
| 800,895 | 9/1956 | Socony | 252/33.4 |
| 1,093,959 | 6/1966 | Peabody | 252/34.7 |
| 2,944,021 | 7/1960 | Ulzheimer et al. | 252/33.4 |
| 2,944,022 | 7/1960 | Ulzheimer et al. | 252/33.4 |
| 2,944,023 | 7/1960 | Kolarik | 252/33.4 |
| 3,121,689 | 2/1964 | Davis | 252/40.5 |
| 3,125,521 | 3/1964 | Detweiler et al. | 252/33.2 X |
| 3,230,169 | 1/1966 | Morway et al. | 252/40.5 X |
| 3,234,131 | 2/1966 | Morway | 252/40.5 |
| 3,374,171 | 3/1968 | Davis et al. | 252/49.3 X |
| 3,791,971 | 2/1974 | Lowe | 252/33.4 |
| 3,983,044 | 9/1976 | Felton, Jr. | 252/49.3 X |
| 4,149,983 | 4/1979 | Grier et al. | 252/49.3 X |
| 4,152,915 | 5/1979 | Bussi et al. | 252/49.3 X |
| 4,243,537 | 1/1981 | Knepp et al. | 252/49.3 |

OTHER PUBLICATIONS

Kirk-Othmer, "Ency. of Chem. Tech.", vol. 10, pp. 641-643, 649-651, 654, 655 and 657-659, 1966.

Serov, V. A. et al., "Prop. of Certain Polyalkylene Glycols for Use in Syn. LCF's" Chem. & Tech. of Fuels and Oils (Russian), vol. 12, Nos. 1-2, 1/76.

*Primary Examiner*—Andrew Metz

*Attorney, Agent, or Firm*—Hedman, Gibson, Costigan & Hoare

[57] ABSTRACT

Aqueous-base compositions are disclosed for the lubrication of the piston and the cylinder liner of Diesel engines, particularly large engines, said compositions essentially comprising one or more water soluble anti-acid neutralizers, a water soluble organic fluid having a high boiling point temperature and one or more water-soluble detergents.

Tests on large engines have shown that it is possible to lubricate the piston and the cylinder liner with an aqueous base fluid without using any crude petroleum derivative.

16 Claims, No Drawings

AQUEOUS NEUTRALIZING AND LUBRICATING COMPOSITION FOR DIESEL ENGINES

This is a continuation of application Ser. No. 327,687 filed Dec. 4, 1981 and now abandoned.

This invention relates to a neutralizing and lubricating composition and its use in Diesel engines. More particularly, the present invention relates to a neutralizing and lubricating composition which is not based on the use of the conventional lubricating fluids, and in which an aqueous component predominates.

It is known that in the large 2-stroke Diesel engines, the lubrication system is twofold: in these engines, actually, there is a normal closed loop system which is composed by a sump and a set of tubings through which the lubricant is dispensed to all the points to be lubricated, whereas, for other spots, such as for the inner top portion of the piston, the fluid is conveyed also to display a typically cooling action.

For the latter type of circuit it has been usual to adopt oily fluids which contained specific oil-soluble additives such as, for example, the rust-preventing additives, the wear-reducing additives, antioxidant and, seldom enough, also neutralizing agents, the more so that in this kind of lubricants the presence of the latter additive is not of primary importance: as a matter of fact, in the closed-loop system, the fluid is active only on those movable component parts of the engine which are comprised between the piston area and the sump area, which are not exposed to the corrosion of the acidic products originated by the combustion. It is known, in fact, that, to reduce their running costs, these engines are fed with heavy fuels containing a high percentage of sulphur (up to 4% and over) and it is apparent that, under these conditions, the acidic combustion products, mainly sulphuric acid, must be neutralized so as not to allow enough time to corrode the metal of the cylinder liners with which they come into contacts.

In addition to the closed loop, there is, in the large 2-stroke Diesel engines, another open loop lubrication circuit which is intended for the lubrication of the liner-and-piston area: the lubricant to be employed for said circuit is directly dispensed onto the liner via an array of bores ("channels") and special dispensing channels ("spider marks") and has, in addition to the lubrication function, the task of neutralizing the condensed acidic residue produced by the combustion.

A lubricant intended for said circuit, therefore, must have quite particular properties and composition and its anti-acid neutralizing action plays a leading role.

At present, the neutralizing function displayed by the conventional lubricants which contain the usual anti-acid additives is characterized by the defect that it is always comparatively toned down because the neutralization reaction takes place in a prevailingly oily environment, or, at least, in an environment in which the only water which is present is that produced in the combustion. Consequently, in the case of the lubrication of the liner-piston couple in the large Diesel engines, the result is that, during the very short time of stay of the portions of anti-acid lubricant which are progressively dispensed on the liner, very often the ideal conditions for neutralizing the entire acidity which is present are not satisfied.

A lubricating and neutralizing composition has now been found, which is adapted to the lubrication of the liner-piston couple of 2-stroke Diesel engines, and is composed of an aqueous solution which is substantially stable in the temperature range from −10° C. to +70° C. and which permits that the acidic products deriving from the combustion may rapidly be neutralized, said composition having quite surprisingly proven to have a lubricating efficiency which is not certainly lower than that of the corresponding oil-based compositions. An object of the present invention is to provide an aqueous composition to be obtained by dissolving in water from 2% to 20% of one or more anti-acid neutralizing substances and from 2% to 20% of one or more substances composed of a water soluble organic fluid having a high boiling point temperature, and/or from 0.5% to 5% of one or more substances having a detergent action.

Examples of anti-acid neutralizing substances are the salts of alkali metals and/or alkaline earth metals, of ammonium, and of monoethanolamine, diethanolamine and triethanolamine, such salts being preferably selected from among the corresponding salts of the acetic, formic and carbonic acids, or morpholine combined with the formic, acetic, propionic, lactic, chloroacetic, thioacetic, butyric, glycerophosphoric and oxalic acids.

Examples of water soluble organic substances having a high boiling point temperature are ethylene glycol, propylene glycol, polyethylene glycol, polypropylene glycol and a few esters, be they water soluble or not.

Lastly, examples of substances having a detergent action are the oxyethylated fatty acids, oxyethylated sorbitol oleate, polyoxylated glycols, ammonium dodecylbenzene sulphonate, alkyldimethylammonium chloride, trimethylamine lauryl sulphate, diethanolamine lauryl sulphate and monoethanolamine lauryl sulphate.

The instant composition may be supplemented, moreover, by the additives having an action like that of the additives used in the lubrication of internal combustion engine, namely:

(1) from 0.5% to 5% of substances having a wear-reducing and jam-preventing action such as dibenzylbisulphide, dibenzylpolysulphide, thiourea and ammonium molybdate, (2) from 0.5% to 5% of substances having a rust-preventing action such as ammonium nitrite, sodium nitrite, boramide and alkali metal bichromates, (3) from 0.5% to 5% of anticorrosive and passivating substances for nonferrous metals, such as benzotriazole.

The procedure for obtaining the solutions according to the present invention do not require any special expedient, with the exception of causing the dissolution of the products enumerated above to take place within a temperature range of from +40° C. to +60° C., preferably, but not compulsorily, the solutions are produced by first dissolving the antiacid neutralizing substance in about one half of the water, whereafter, once the dissolution has been obtained, the substance having a detergent action is added and, subsequently, all the other components which had previously been dissolved in the second half of the water volume.

The solutions are clear and have a colour which tends to brown-yellow and, as outlined above, they are stable within the temperature range of from −10° C. to +70° C.: this is a property which enables such solutions to be stored for long periods of time. Examples of such solutions, to be used for the lubrication of the liner-piston couple of 2-stroke Diesel engines may be as follows:

(A) Calcium acetate: 8%; polyethylene glycol: 7%; ammonium dodecylbenzene sulphonate: 2%; dibenzyl disulphide: 1%; boramide: 2%, water 80%, all on a weight basis.

(B) Magnesium acetate: 6%; polypropylene glycol: 7%; diethanolamine lauryl sulphate: 3%; thiourea: 2%; ammonium molybdate: 1%; water: 81%.

(C) Calcium acetate: 5%; magnesium acetate: 3%; polyethylene glycol: 9%; oxyethylated sorbitol oleate: 3%; ammonium molybdate: 3%; boramide: 2%; water: 75%.

(D) Acetylmorpholine: 10%; polyethylene glycol: 8%; monoethanolamine lauryl sulfate: 2%; thiourea: 2%; ammonium nitrite: 2%; benzotriazole: 1%; water: 75%.

(E) Magnesium formate: 7%; ethylene glycol: 9%; alkyldimethylammonium chlorde: 3%; dibenzylpolysulphide: 3%; potassium bichromate: 2%; benzotriazole: 1%; water: 75%.

(F) Sodium acetate: 4.5%; sodium carbonate: 3%; ethylene glycol: 10%; diethanolaminelauryl sulphate: 3%; thiourea: 2%; boramide: 2.5%; water: 75%.

A fact which deserves careful consideration is that the indication of 2-stroke Diesel engines having separate lubrication circuits should be regarded as a mere example of the invention and does not imply any limitation, the more so that the first practical test for assaying a solution such as suggested above has been performed by using a small single-cylinder engine, Petter AVl, which has a single sump lubrication system. With this test, very satisfactory results have been obtained, both from the point of view of the lubrication of the piston-liner couple, and lubrication of the sump area. This result confirms, in quite reliable a manner, that also in certain parts of the engine the lubrication can be made without using petroleum-based lubricating fluids and non-petroleum based fluids having a high viscosity.

A further confirmation has been received from all a set of tests carried out with the compositions according to the present invention, which are reported hereafter by way of example only and without limitations.

EXAMPLE 1

Composition A has been used for the lubrication of the liner-piston couple of the two Diesel engines used for propelling the motor-tanker "Cortemaggiore" having a 18,000 tons carrying capacity (main engine is FIAT 7510, suction type, 8,050 HP, 125 rpm) and for the motor tanker AGIP TRIESTE, 50,000 tons d.w. (main engine is FIAT 989B, supercharged, 18,900 HP, 125 rpm).

On the engines of the two motor tankers assay tests have been carried out, which lasted a few hundreds hours in order to check the overall behaviour of the fluids in question.

The rate of flow of the dispensed fluid has been the same as used for the conventional petroleum-based lubricants about 0.8 grams per horsepower and per hour.

On completion of the tests, the readings which have been taken have clearly shown that the lubricant compositions of the invention fulfil the requirements of those types of engines.

What has been noted, above all, is the excellent degree of cleanliness, the complete freedom of the piston rings and the tendency of having wear values for the rings confined within the standard specifications.

EXAMPLE 2

Data relating to the test made on the Petter AVJ engine with the fluid having the composition A.

| | |
|---|---|
| Engine specifications: | |
| No of cylinders | 1 |
| Bore | 80 mm |
| Stroke | 110 mm |
| Displacement | 553 $cm^3$ |
| Rotation speed | 1500 rpm |
| Compression ratio | 20:1 |
| Nominal power | 5 HP |
| Operation conditions: | |
| Fuel consumption | 1.088 kg an hour |
| Outlet temperature of collant | 85° C. |
| Temperature of lubricant in sump | 55° C. |
| Pressure of lubrication (comp. A) | 2.5 $kg/cm^2$ |
| Lubricant charge | 3.4 kg |

On the engine in question a 22-hour test has been carried out under standard conditions.

On completion of the test, the conditions of the several component parts of the engine were found to be normal and more particularly, the piston rings appeared to be free and had no incrustations; also the component parts which were contacted by the fluid under test were under normal conditions and no dense residues have been found, nor in such an amount as to compromise the engine operation.

I claim:

1. A neutralizing and lubricating composition which comprises:

(a) from 2 to 20% on a weight basis of an antacid substance selected from the group consisting of magnesium acetate, calcium acetate, acetylmorpholine, magnesium formate, sodium acetate, sodium carbonate and mixtures thereof;

(b) from 2 to 20% on a weight basis of a water soluble organic substance selected from the group consisting of ethylene glycol, propylene glycol, polyethylene glycol and polypropylene glycol;

(c) from 0.5% to 5% on a weight basis of a capillary active agent selected from the group consisting of oxyethylated sorbitol oleate, ammonium dodecylbenzene sulfonate, diethanolamine lauryl sulfate, monoethanolamine lauryl sulfate and alkyldimethylammonium chloride; and (d) a major amount of water.

2. A composition as defined in claim 1 which comprises:

as component (a), 8% by weight of calcium acetate;

as component (b), 7% by weight of polyethylene glycol;

as component (c), 2% by weight of ammonium dodecylbenzene;

and further comprising 2% by weight of boramide; and

1% dibenzoyl disulphide; and as component (d), 80% by weight of water.

3. A composition as defined in claim 1 which comprises:

a component (a), 6% by weight of magnesium acetate;

as component (b), 7% by weight of polypropylene glycol;

as component (c), 3% by weight of diethanolamine lauryl sulfate;

and further comprising 2% by weight of thiourea; and

1% by weight of ammonium moybdate; and as component (d), 81% by weight of water.

4. A composition as defined by claim 1 which comprises:

as component (a), 5% by weight of calcium acetate; and

3% by weight of magnesium acetate;

as component (b), 9% by weight of polyethylene glycol;

as component (c), 3% by weight of oxyethylated sorbitol oleate; and further comprising 3% by weight of ammonium molybdate; and 2% by weight of boramide; and as component (d), 75% by weight of water.

5. A composition as defined by claim 1 which comprises:

as component (a), 10% by weight of acetylmorpholine;

as component (b), 8% by weight of polyethylene glycol;

as component (c), 2% by weight of monoethanoloamine lauryl sulfate;

and further comprising 2% by weight of thiourea,

2% by weight of ammonium nitrite and

1% by weight of benzotriazole; and as component (d), 75% by weight of water.

6. A composition as defined by claim 1 which comprises:

as component (a), 7% by weight of magnesium formate;

as component (b), 9% by weight of ethylene glycol;

as component (c), 3% by weight of alkyldimethylammonium chloride; and further comprising 3% by weight of dibenzoylpolysulphide, 2% by weight of potassium bichromate and 1% by weight of benzotriazole; and as component (d), 75% by weight of water.

7. A composition as defined by claim 1 which comprises:

a component (a), 4.5% by weight of sodium acetate; and

3% by weight of sodium carbonate;

as component (b), 10% by weight of ethylene glycol;

as component (c), 3% by weight of diethanolamine lauryl sulphate, and further comprising, 2% by weight of thiourea and 2.5% by weight of boramide; and as component (d), 75% by weight of water.

8. A composition as defined in claim 1 which further comprises:

(i.) from 0.5 to 5% by weight of a substance having a wear-reducing action;

(ii.) from 0.5 to 5% by weight of a substance having a rust-preventing action; and (iii.) from 0.5 to 5% by weight of a corrosion-preventing and passivating substance for nonferrous metals.

9. A composition as defined in claim 1 which further comprises dibenzoylpolysulphide as a substance having a wear-reducing action.

10. A composition as defined in claim 1 which further comprises thiourea as a substance having a wear-reducing action.

11. A composition as defined in claim 1 which further comprises ammonium molybdate as a substance having a wear-reducing action.

12. A composition as defined in claim 8 which further comprises ammonium nitrite as a substance having a rust-preventing action.

13. A composition as defined in claim 8 which further comprises sodium nitrite as a substance having a rust-preventing action.

14. A composition as defined in claim 8 which further comprises boramide as a substance having a rust-preventing action.

15. A composition as defined in claim 8 which further comprises an alkali metal bichromate as a substance having a rust-preventing action.

16. A composition as defined in claim 8 which further comprises benzotriazole as a corrosion-preventing and passivating substance for nonferrous metals.

* * * * *